US008036553B2

(12) United States Patent
Endou et al.

(10) Patent No.: US 8,036,553 B2
(45) Date of Patent: Oct. 11, 2011

(54) IMAGE FORMING APPARATUS PROVIDED WITH CALIBRATION FUNCTION

(75) Inventors: Hirohisa Endou, Osaka (JP); Masaki Hayashi, Osaka (JP)

(73) Assignee: Kyocera Mita Corporation (JP)

( * ) Notice: Subject to any disclaimer, the term of this patent is extended or adjusted under 35 U.S.C. 154(b) by 430 days.

(21) Appl. No.: 12/277,335

(22) Filed: Nov. 25, 2008

(65) Prior Publication Data

US 2009/0136249 A1 May 28, 2009

(30) Foreign Application Priority Data

Nov. 27, 2007 (JP) ..... 2007-305744
Mar. 26, 2008 (JP) ..... 2008-079521

(51) Int. Cl.
*G03G 15/00* (2006.01)

(52) U.S. Cl. ..... 399/49

(58) Field of Classification Search ..... 399/49, 399/40, 72

See application file for complete search history.

(56) References Cited

U.S. PATENT DOCUMENTS 5,381,221 A * 1/1995 Mizoguchi et al. ..... 399/40
2003/0012578 A1 * 1/2003 Ishii et al. ..... 399/49

FOREIGN PATENT DOCUMENTS

JP 9-50155 2/1997
JP 2002049196 A * 2/2002
JP 2005352371 A * 12/2005

* cited by examiner

*Primary Examiner* — Quana M Grainger
(74) *Attorney, Agent, or Firm* — Gerald E. Hespos; Michael J. Porco

(57) ABSTRACT

An image forming apparatus is provided with an image bearing member, a line test image forming section for forming a line test image made up of a plurality of line images arranged side by side on the image bearing member, an image density detecting section for detecting the density of the line test image formed on the image bearing member or the line test image transferred from the image bearing member to a transfer member, and a setting section for setting an image forming condition based on the density of the line test image.

16 Claims, 9 Drawing Sheets

[TEST CONDITION 1]

[TEST CONDITION 2]

[TEST CONDITION 3]

IMAGE FORMING APPARATUS PROVIDED WITH CALIBRATION FUNCTION

BACKGROUND OF THE INVENTION

1. Field of the Invention

The present invention relates to an image forming apparatus capable of performing a calibration process for adjusting an image forming condition.

2. Description of the Related Art

An electrophotographic image forming apparatus such a printer, copier, facsimile machine or a complex machine of these includes an image bearing member such as a photoconductive drum and a developing unit for forming an output image (toner image) by supplying developer (toner). The outer surface of the image bearing member is uniformly charged by a charger and exposed by the irradiation of a laser light to form an electrostatic latent image.

The developing unit is arranged near the image bearing member and includes a developer bearing member (development sleeve) for bearing the developer. The developer on the developer bearing member is excited by a development bias voltage to adhere to the electrostatic latent image on the outer surface of the image bearing member. In this way, the above output image is formed on the outer surface of the image bearing member.

Generally, an image forming apparatus has image forming parameters, which are operating conditions of the image forming apparatus influential to the density setting of the output image and adopted to ensure good image quality. These image forming parameters include, for instance, exposure conditions such as the exposure power of laser light to be irradiated to the image bearing member, charging conditions of the outer surface of the image bearing member and developing conditions such as a development bias voltage of a developer bearing member and a surface speed ratio (hereinafter, "circumferential speed ratio") between the developer bearing member and the image bearing member. These conditions change with time or according to a surrounding environment. Therefore, good image quality cannot be constantly ensured if the image forming parameters are fixed.

Because of this situation, a calibration process has been conventionally performed to properly adjust the above image forming parameters. An example of a conventional calibration process is a process for forming a solid patch image on an image bearing member, detecting the density of this image and adjusting image forming parameters such that the detected density satisfies a target density. It should be noted that the solid patch image is a toner image solid to have a fixed density in a specified area of the image bearing member.

On the other hand, Japanese Unexamined Patent Publication No. H09-50155 (D1) discloses a calibration process in the following process of (1)→(2).

(1) A solid patch image is formed, the density thereof is detected, such a circumferential speed ratio (ratio between the circumferential speed of the image bearing member and that of the development sleeve) that the detected density is a target density is estimated and the estimated circumferential speed ratio is set as an image forming parameter for an image forming process.

(2) A line test image (image in which a plurality of line images are arranged side by side) is formed at the circumferential speed ratio set in the above process (1), exposure power necessary to obtain an optimal line width is estimated based on the detected density, and the estimated exposure power is set as an image forming parameter for the image forming process.

The image density is generally detected by detecting the quantity of light irradiated to a specified area of an image and reflected thereby. The density of the solid patch image detected by this method changes to a very small extent in relation to an increase in the amount of developer supplied to the image bearing member since the reflected light quantity saturates if the amount of the developer (hereinafter, "developer amount") supplied to the image bearing member exceeds a specified quantity by adjustments of the image forming parameters such as the development bias voltage. Thus, if the developer amount is mainly adjusted based on the detected density of only the solid patch image, the developer amount tends to be excessive to ensure the density of the solid patch image. As a result, there is a problem of degrading image quality due to image damage by the excessive supply of the developer upon developing images of characters or line drawings.

Thus, the image forming parameters need to be adjusted also in consideration of image qualities of characters, line drawings, etc. so that the developer is not excessively supplied upon developing images of characters or line drawings. However, no sufficient consideration is made on this point in the above D1 document. In other words, the exposure power is changed based on the detected density of the line test image according to the technology of the D1 document, but it is already known that a change of the exposure power is unlikely to be reflected on the developer amount. Therefore, it is difficult to solve the excessive supply of the developer by the exposure power.

The change of the exposure power also causes the following problem. For example, in a negative charging system, the width of line images (hereinafter, "line width") increases if the exposure power is increased. Thus, image damage is more unlikely to occur upon developing images of characters and line drawings, whereby image quality is further degraded. On the other hand, the line width decreases if the exposure power is decreased, but the density of the output image is simultaneously decreased to result in light images, wherefore good images of characters and line drawings are not formed.

Here, the circumferential speed ratio exists as the image forming parameter for adjusting the supplied amount of the developer to the image bearing member. If the circumferential speed ratio is excessively large, the line width becomes excessively thick in a sub scanning direction. If the circumferential speed ratio is excessively small, an opposite situation occurs.

SUMMARY OF THE INVENTION

An object of the present invention is to provide an image forming apparatus capable of calibrating an image forming parameter to develop line images with a necessary and sufficient developer amount, whereby good image quality can be realized.

In order to accomplish this object, one aspect of the present invention is directed to an image forming apparatus, comprising an image bearing member; a line test image forming section for forming a line test image made up of a plurality of line images arranged side by side on the image bearing member; an image density detecting section for detecting the density of the line test image formed on the image bearing member or the line test image transferred from the image bearing member to a transfer member; and a setting section for setting an image forming condition based on the density of the line test image.

DETAILED DESCRIPTION OF THE PREFERRED EMBODIMENTS

One embodiment of the present invention is described to understand the present invention with reference to the accompanying drawings. The following embodiment is merely a specific example of the present invention and is not of the nature to limit the technical scope of the present invention.

Figure 1:
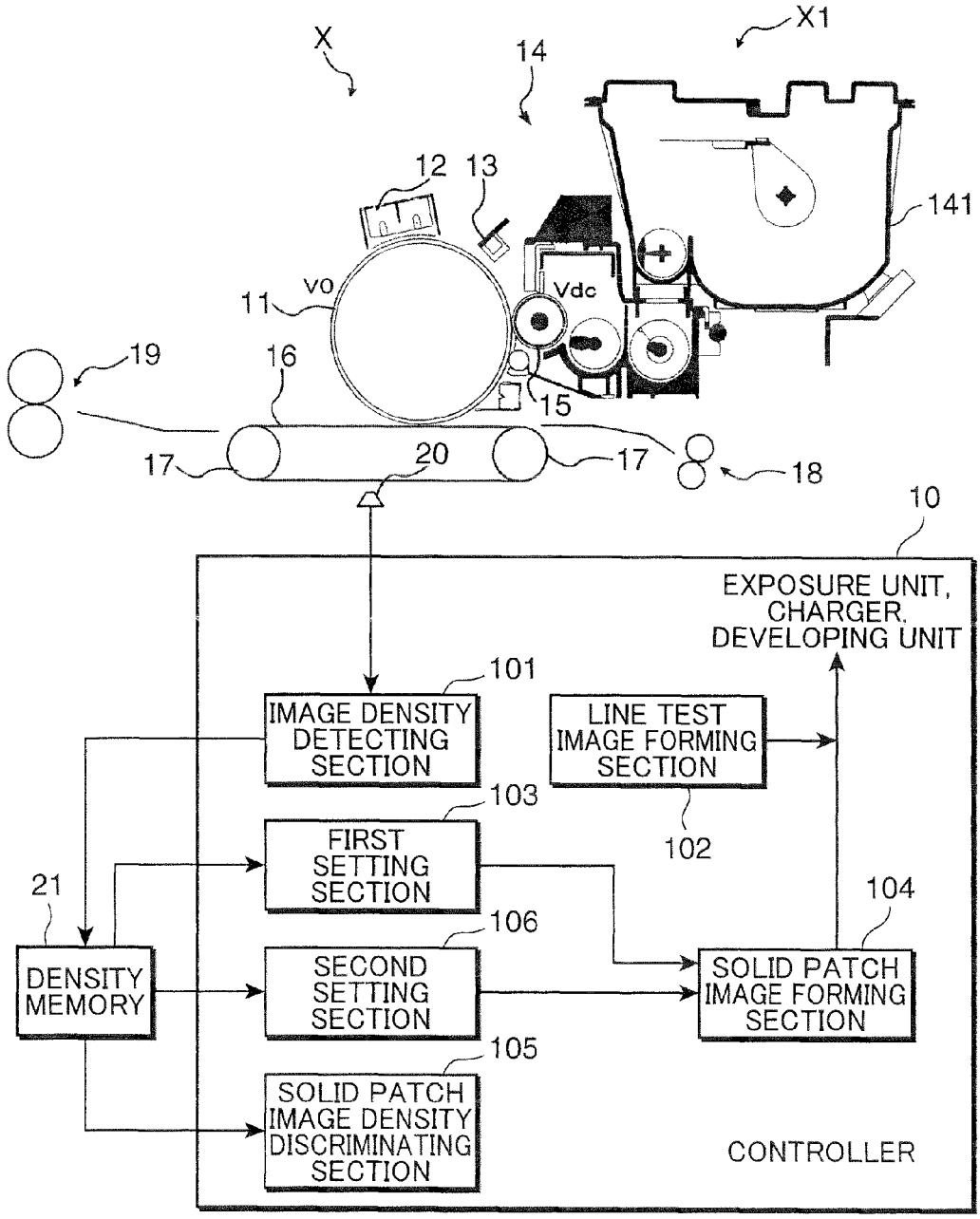
FIG. 1 is a diagram showing a main part of an image forming apparatus according to one embodiment of the invention.

FIG. 1 is a diagram (block diagram partly in section) showing a main part of an image forming apparatus X according to the embodiment of the present invention. First of all, with reference to FIG. 1, the construction of the image forming apparatus X is described. The image forming apparatus X is an electrophotographic image forming apparatus such as a printer, copier, facsimile machine or a complex machine of these.

The image forming apparatus X is provided with an image forming station X1 for forming an image on a recording sheet by forming a toner image, a sheet feeding unit (not shown) for supplying a recording sheet to the image forming station X1 and a sheet discharging unit (not shown), to which the recording sheet having an image formed thereon is discharged.

The image forming station X1 includes a photoconductive drum 11 (an example of an image bearing member), a charger 12, an exposure unit 13, a developing unit 14 and a transfer belt 16 (transfer member) arranged around the photoconductive drum 11. Registration rollers 18 are arranged upstream of the image forming station X1, whereas fixing rollers 19 are arranged downstream thereof. The operation of the image forming station X1 is controlled by a controller 10.

The photoconductive drum 11 is a cylindrical body rotatable about a rotation axis thereof and bears an electrostatic latent image and a toner image on the outer surface thereof. The charger 12 uniformly charges the outer surface of the photoconductive drum 11 along a rotation axis direction. The exposure unit 13 includes a laser light source and irradiates laser light corresponding to image information to the outer surface of the photoconductive drum 11 for exposure, thereby forming an electrostatic latent image. The developing unit 14 supplies toner (an example of developer) to the outer surface of the photoconductive drum 11 having the electrostatic latent image formed thereon, thereby developing the electrostatic latent image into a toner image. The toner is suitably supplied from a toner container 141 to this developing unit 14.

The developing unit 14 includes a development sleeve 15 (an example of a developer bearing member) for supplying the toner to the photoconductive drum 11. The development sleeve 15 is for bearing the toner on the outer circumferential surface thereof, and a development bias voltage Vdc is applied thereto. The toner on the development sleeve 15 is attached toward the outer surface of the photoconductive drum 11 according to a potential gap between the surface potential of the development sleeve 15 and that of the photoconductive drum 11. In this way, the electrostatic latent image is developed into the toner image.

The transfer belt 16 is supported by a belt supporting roller 17 and driven by the rotation of the belt supporting roller 17. The toner image developed on the outer surface of the photoconductive drum 11 is transferred to a recording sheet being conveyed on the outer surface of the transfer belt 16. In a printer or the like for forming a full color image, toner images are primarily transferred to a transfer belt and are secondarily transferred from this transfer belt to a recording sheet.

The registration rollers 18 temporarily stop the recording sheet conveyed by unillustrated feed rollers and conveys the recording sheet onto the surface of the transfer belt 16 in synchronism with the leading end of the toner image formed on the outer surface of the rotating photoconductive drum 11.

The fixing rollers 19 heat and press the recording sheet having the toner image transferred thereto on the outer surface of the transfer belt 16 to melt the toner and fix it to the recording sheet.

Although the image forming station X is also provided with known constituent elements provided in general electrophotographic image forming apparatuses, they are not described here.

The controller 10 is a circuit including a MPU (micro processing unit), its peripheral devices and the like, and fulfills a plurality of functions for each program module executed by the MPU. The controller 10 has a function of setting parameters for image formation and a function of performing a calibration process for setting optimal image forming parameters.

The controller 10 is functionally provided with an image density detecting section 101, a line test image forming section 102, a first setting section 103 (a part of a setting section), a solid patch image forming section 104, a solid patch image density discriminating section 105 and a second setting section 106 (a part of the setting section). An image density detecting sensor 20 and a density memory 21 (storage) are connected to this controller 10.

The image density detecting section 101 detects the densities of line test images 22, 23 to be described later and the density of a solid patch image 24 in accordance with an electrical signal outputted from the image density detecting sensor 20. The line test image forming section 102 forms line test images, in each of which a plurality of line images are arranged side by side, on the outer surface of the photoconductive drum 11. The first setting section 103 sets image forming parameters employed for an actual image forming process based on the densities of the line test images. The solid patch image forming section 104 forms the solid patch image on the outer surface of the photoconductive drum 11. The solid patch image density discriminating section 105 discriminates whether or not the density of the solid patch image exceeds a predetermined solid patch image target density. The second setting section 106 sets image forming parameters employed for the actual image forming process based on the density of the solid patch image.

The image density detecting sensor 20 includes a light emitting element and a light receiving element. Light emitted from the light emitting element to a specified area of the toner image and reflected thereby is received by the light receiving element to be converted into an electrical signal. This electrical signal is outputted as a detection signal of the image density. The image density detecting sensor 20 may detect the density of an image formed on the outer surface of the photoconductive drum 11 or the density of an image formed on a recording sheet in addition to detecting the density of an image transferred to the outer surface of the transfer belt 16.

The density memory 21 temporarily stores the densities of the line test images 22, 23 and the solid patch image 24 detected by the image density detecting section 101. Predetermined line test image target density and solid patch image target density are stored beforehand in the density memory 21. These target density values are values preset by a manufacturer or the like as references for the output of good quality images.

Figure 4:
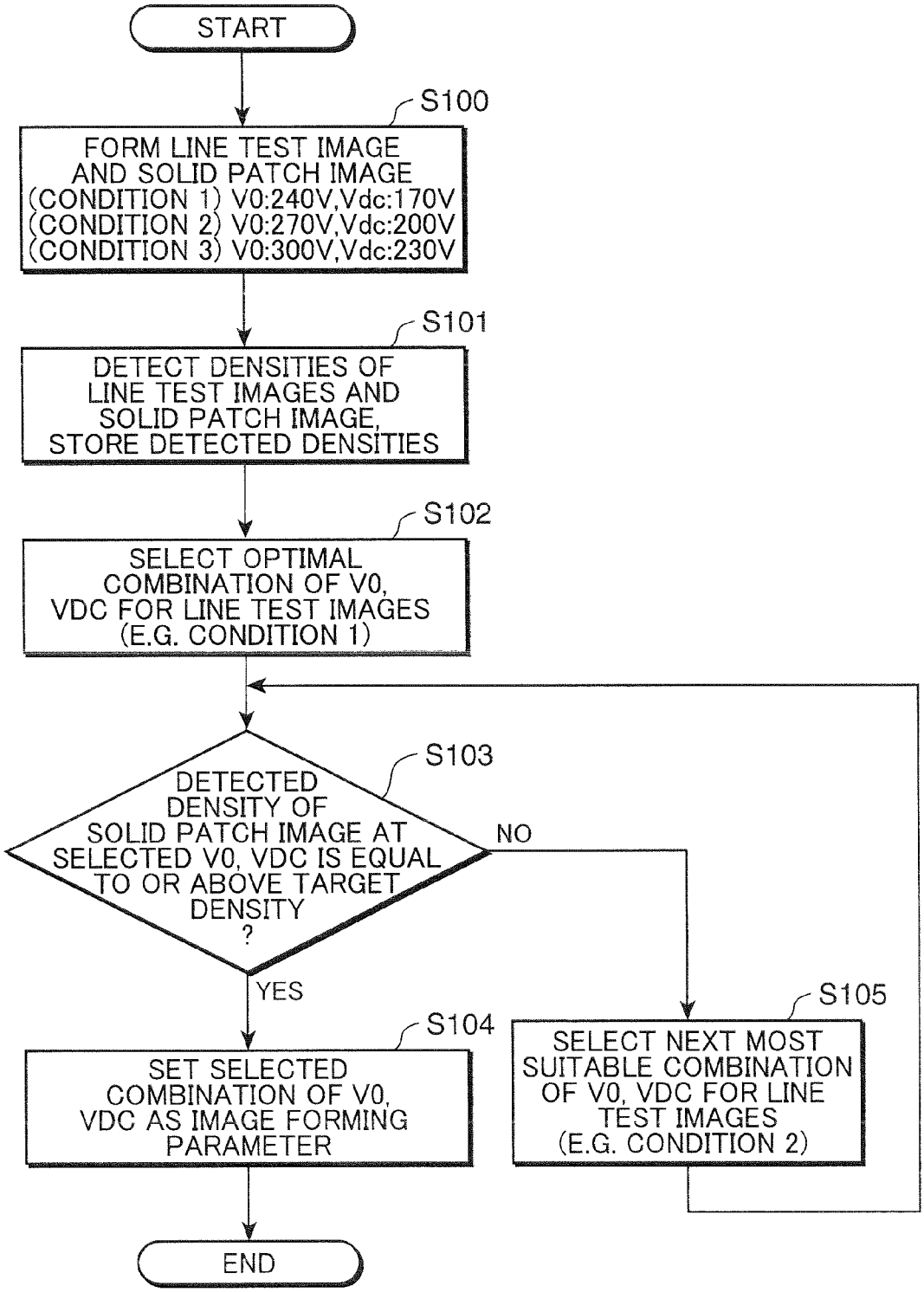
FIG. 4 is a flow chart showing an example of the calibration process.

Next, the calibration process for the image forming parameters of the image forming apparatus X according to this embodiment is described with reference to a flow chart of FIG. 4. Here, S100, S101, S102, S103, S104 and S105 indicate the numbers of procedure (steps) of the calibration process. This calibration process is performed, for example, when the image forming apparatus X is turned on or after the image forming apparatus X outputs a specified number of prints of an image.

(Step S100)

Figure 2A:
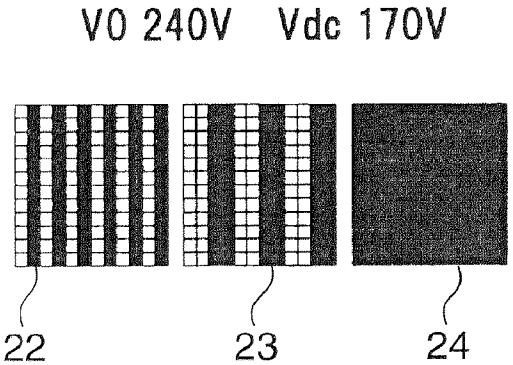
FIGS. 2A to 2C are diagrams showing examples of test images formed during a calibration process of image forming parameters.
Figure 2B:
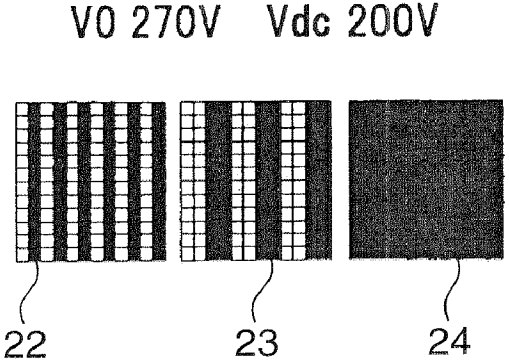
Figure 2C:
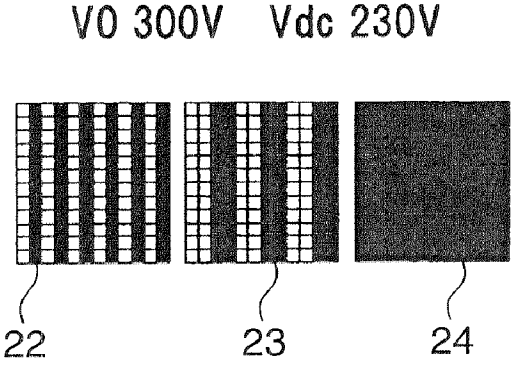

In the calibration process, the line test images 22, 23 and the solid patch image 24, in each of which a plurality of line images as shown in FIGS. 2A to 2C are arranged side by side, are formed on the outer surface of the photoconductive drum 11 by the line test image forming section 102 and the solid patch image forming section 104. These are respectively formed under a plurality of test conditions (test conditions 1 to 3), in which a combination of a charge voltage V0 on the outer surface of the photoconductive drum 11 and the development bias voltage Vdc on the outer surface of the development sleeve 15 differs. Here, the test condition means an operation condition of the image forming apparatus X influential to the density setting of an output image.

The image forming parameters differing in the respective test conditions 1 to 3 in this embodiment include the charge voltage V0 on the outer surface of the photoconductive drum 11 and the development bias voltage Vdc to be applied to the development sleeve 15. As respectively shown in FIGS. 2A to 2C, the test conditions 1 to 3 are as follows.

Test condition 1: V0=240 V, Vdc=170 V

Test condition 2: V0=270 V, Vdc=200 V

Test condition 3: V0=300 V, Vdc=230 V

Figure 3:
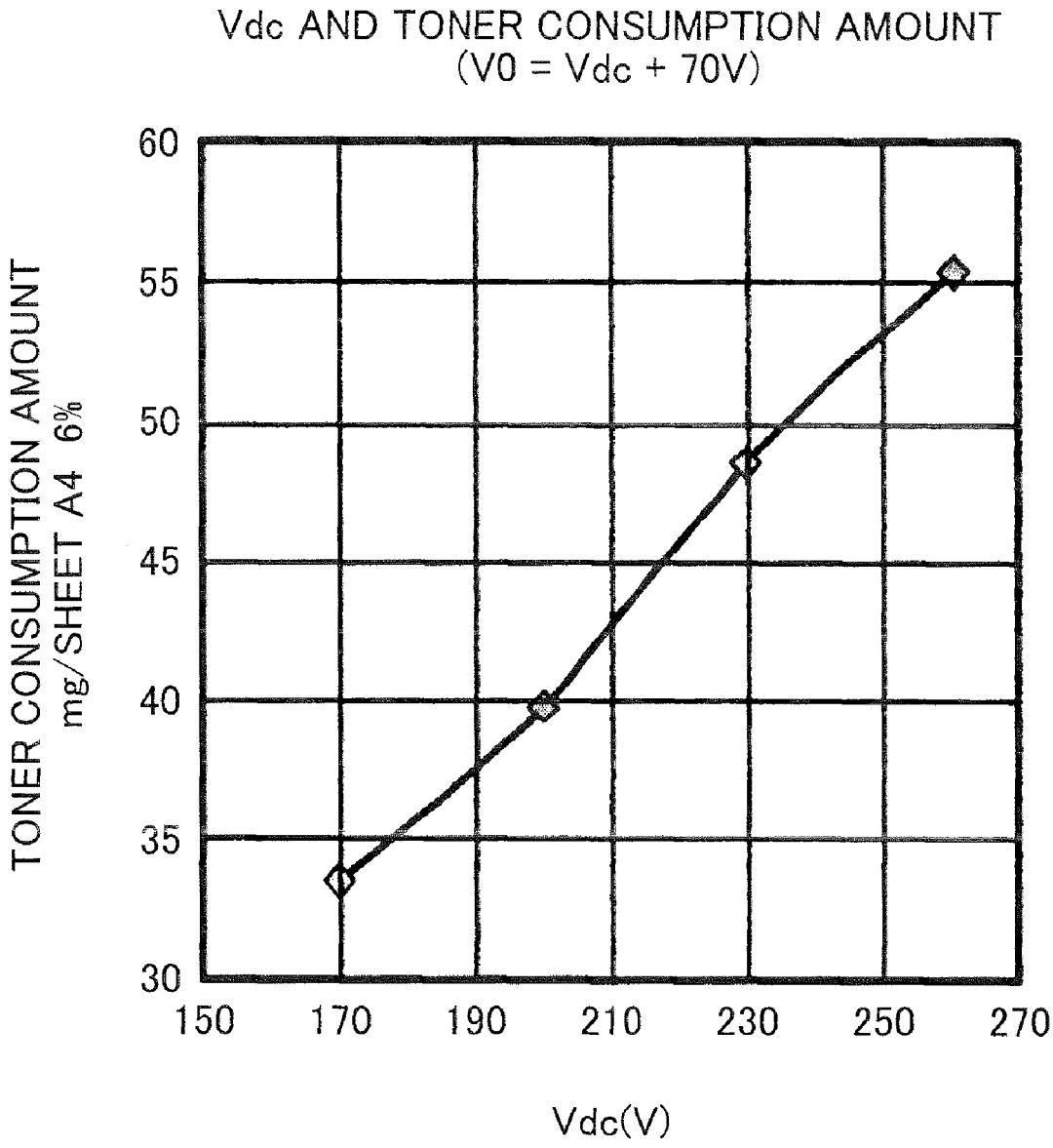
FIG. 3 is a graph showing a correlation between a charging voltage on the outer surface of an image bearing member and a development bias voltage of a developer bearing member and a developer amount corresponding to each combination.

FIG. 3 is a graph showing a correlation between the condition of the charge voltage V0 and the development bias voltage Vdc and a developer amount (toner consumption amount). In FIG. 3, a horizontal axis represents the development bias voltage Vdc. The graph of FIG. 3 shows a result when development was made under a condition that the charge voltage V0 is set such that a potential difference from the development bias voltage Vdc is constantly 70 V.

Figure 5:
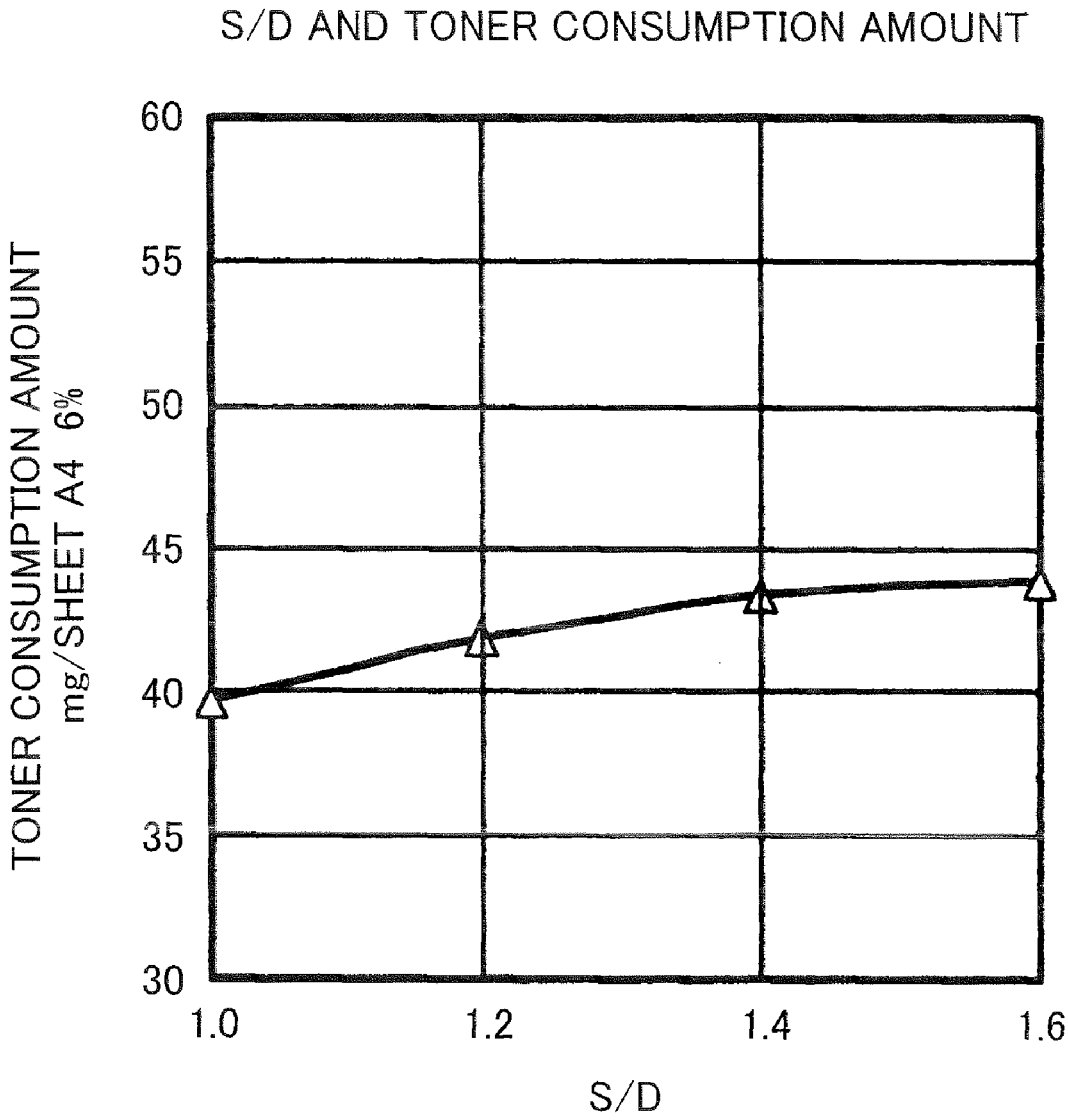
FIG. 5 is a graph showing a circumferential speed ratio between the outer surface of the image bearing member and that of the developer bearing member and a toner consumption amount.

On the other hand, FIG. 5 is a graph showing a correlation between a ratio of the circumferential speed (D) of the photoconductive drum 11 and the circumferential speed (S) of the development sleeve 15 (hereinafter, "circumferential speed ratio") and a developer amount (toner consumption amount) per unit area. The circumferential speed ratio is a typical example of a ratio of the surface speed of the photoconductive drum 11 and that of the development sleeve 15.

As can be understood by the comparison of FIGS. 3 and 5, the voltage condition of the charge voltage V0 and the development bias voltage Vdc is very highly sensitive as an adjustable parameter for the developer amount as compared with the circumferential speed ratio. Even if the charge voltage V0 and the development bias voltage Vdc are adjusted, an area where an image is developed (area where the toner adheres) does not change as in the case of adjusting the exposure power by the exposure unit 13 and, hence, the width of line images (line width) does not change very much.

The above similarly holds in the case of employing either one of the charge voltage V0 and the development bias voltage Vdc as an image forming parameter. In other words, the higher the charge voltage V0, the smaller the developer amount (toner consumption amount per unit area). Further, the lower the development bias voltage Vdc, the smaller the developer amount.

In FIG. 3, the development bias voltage Vdc is changed while the difference between the charge voltage V0 and the development bias voltage Vdc is kept constant. By doing so, the reproducibility of a dot image (image of one independent pixel) becomes stable.

In this embodiment, a first test condition on which the line test image forming section 102 forms the line test images 22, 23 and a second test condition on which the solid patch image forming section 104 forms the solid patch image are the same test conditions. In the first and second test conditions, a combination of the charge voltage V0 and the development bias voltage Vdc changed stepwise may differ.

The line test images 22, 23 and the solid patch image 24 can be formed on the outer surface of the photoconductive drum 11 or on the recording sheet. In this embodiment is exemplified a case where the line test images 22, 23 and the solid patch image 24 formed on the photoconductive drum 11 are transferred to the outer surface of the transfer belt 16 and these transferred images are detected by the image density detecting sensor 20.

The line test images 22, 23 are formed by arranging a plurality of line images having a line width of 0.5 mm to 2 mm, at which characters and line drawings are often formed. In this embodiment, as exemplified in FIGS. 2A to 2C, line images of 1-dot width are arranged at every other dot in a main scanning direction in the line test image 22, line images of 2-dot width are arranged at intervals of two dots in the main scanning direction in the line test image 23 and the solid patch image 24 is a solid image of a specified rectangular area with a fixed density.

The line test images 22, 23 are formed over a range wider than a detection range of the image density detecting sensor 20, and the solid patch image 24 is also formed over a range wider than the detection range of the image density detecting sensor 20.

(Step S101)

Subsequently, a density detecting operation by the image density detecting sensor 20 for each of the line test images 22, 23 and the solid patch image 24 transferred to the outer surface of the transfer belt 16 is performed. An output signal of the image density detecting sensor 20 is fed to the controller 10, and the image density detecting section 101 calculates the detected density based on the output signal and writes the corresponding data in the density memory 21. The density memory 21 temporarily stores this data.

The densities of the line test images formed under a certain image forming parameter include the density of the line test image 22 and that of the line test image 23. In this embodiment, an average value of these two densities is calculated and stored in the density memory 21. By calculating the average value in this way, a variation of the detected density caused by the intervals of the line images and the variation of the line width can be solved.

In order to discriminate the developer amount used for developing each of the line test images 22, 23 and the solid patch image 24, it is optimal to detect the developer amount used for each developing operation, but such detection is difficult. However, if the developer amount used for the development increases, the image densities of the line test images 22, 23 and the solid patch image 24 increase. Accordingly, in the image forming apparatus X, the detected density of the image density detecting sensor 20 is used as an alternative indication value of the developer amount.

(Steps S102 to S105)

In principle, the first setting section 103 performs a first image forming parameter setting process to be described later to set an image forming parameter employed for an actual image forming process in the image forming apparatus X. However, exceptionally, if the detected density of the solid patch image 24 formed under the first image forming parameter set in the first setting section 103 is below the predetermined solid patch image target density, the second setting section 106 performs a second image forming parameter setting process instead of the first setting section 103 to set an image forming parameter employed for the actual image forming process.

The contents of the first image forming parameter setting process performed by the first setting section 103 and the second image forming parameter setting process performed by the second setting section 106 are separately described below.

[First Image Forming Parameter Setting Process]

(Step S102)

The first setting section 103 obtains data on the detected densities of a plurality of line test images 22, 23 formed under different image forming parameters (test conditions 1 to 3) and data on the predetermined line test image target density (e.g. 0.8) from the density memory 21. By comparing the two data, a combination of the charge voltage V0 and the development bias voltage Vdc when the line test images 22, 23 having lowest detected densities above the line test image target density is selected out of the test conditions 1 to 3. For example, if the test condition 1 satisfies this requirement, the image forming parameter of V0=240 V, Vdc=170 V is selected as a candidate for the actual image forming process.

Here, a case where any of the densities obtained under the test conditions 1 to 3 exceeds the line test image target density can also be supposed. In this case, a combination of the charge voltage V0 and the development bias voltage Vdc when the line test images 22, 23 whose detected densities were closest to the target density were developed may be selected. In short, it is sufficient to select a combination of the charge voltage V0 and the development bias voltage Vdc when the line test images 22, 23 whose detected densities were closest to the line test image target density were developed may be selected.

Even if the combination of the charge voltage V0 and the development bias voltage Vdc selected based only on the detected densities of the line test images 22, 23 is set as the image forming parameter employed for the image forming process without referring to the detected density of the solid patch image 24 in this way, good image quality can be set for line images.

However, by also referring to the detected density of the solid patch image 24 to be described later, better images of characters and line drawings can be formed. Such a process is described below.

[Second Image Forming Parameter Setting Process]

(Step S103)

The solid patch image density discriminating section 105 obtains data on the detected density of the solid patch image 24 formed under the image forming parameter including the combination of the charge voltage V0 and the development bias voltage Vdc selected by the first setting section 103 and data on the predetermined solid patch image target density (e.g. 0.8) from the density memory 21. Then, the solid patch image density discriminating section 105 discriminates whether or not the detected density of the solid patch image 24 is equal to above the predetermined solid patch image target density.

(Step S104)

As a result, if the obtained detected density of the solid patch image 24 is equal to or above the predetermined solid patch image target density, the first setting section 103 sets the image forming parameter including the combination of the charge voltage V0 and the development bias voltage Vdc selected in Step S102 as the image forming parameter for the image forming process. For example, if the image forming parameter selected in Step S102 is the test condition 1 of V0=240 V, Vdc=170 V, this is set as the image forming parameter for the actual image forming process.

On the other hand, if the solid patch image 24 formed under the image forming parameter set by the first setting section 103 is below the solid patch image target density in Step S103, the second setting section 106 sets the image forming parameter instead of the first setting section 103.

Thus, the image forming parameter selected by the first setting section 103 and the one selected by a process to be described later by the second setting section 106 are stored in a memory (not shown) referable by the second setting section 106.

The image forming parameter setting process by the second setting section 106 means the following process repeatedly performed until the detected density of the solid patch image 24 formed under the presently selected image forming parameter (i.e. the image forming parameter stored in the memory referable by the second setting section 106) increases to or above the predetermined solid patch image target density.

(Step S105)

The second setting section 106 refers to the density memory 21 and selects the image forming parameter, under which the detected densities are closest to the line test image target density, next to the presently selected image forming parameter for the line test images 22, 23. In other words, except the presently selected image forming parameter, the image forming parameter, under which the detected densities of the line test images 22, 23 are equal to or above the line test image target density and are the lowest (closest to the above target density), is selected. For example, if the test condition 2 satisfies this requirement, the image forming parameter of V0=270 V, Vdc=200 V is selected.

(Step S103)

Subsequently, the second setting section 106 discriminates whether or not the detected density of the solid patch image 24 formed under the image forming parameter selected in Step S105 is equal to or above the predetermined solid patch image target density. If the detected density of the solid patch image 24 is equal to or above the solid patch image target density, Step S104 follows. In this case, the second setting section 106 sets the image forming parameter selected in Step S105 as the image forming parameter employed for the actual image forming processing. For example, if the test condition 2 of V0=270 V, Vdc=200 V was selected in Step S105, this is set as the image forming parameter for the actual image forming processing.

On the other hand, if the detected density of the solid patch image 24 selected in Step S105 is below the solid patch image target density, the processing of Step S105 is performed again.

According to the image forming apparatus X of this embodiment described above, the image forming parameter can be adjusted so that the line images can be developed with the necessary and sufficient amount of developer and at the line width which is neither too thick nor too thin. Accordingly, good image quality can be realized upon developing images of characters and line drawings. By setting the image forming parameter within such a range that the detected density of the solid patch image 24 satisfies the solid patch image target density, such an image forming parameter as to better the image quality of characters and line drawings can be set while the minimum density of the solid patch image is ensured.

DESCRIPTION OF MODIFICATIONS

First Modification

In the above embodiment is exemplified the example in which the image forming parameter is set based only on the detected densities of the line test images 22, 23 and the solid patch image 24 actually formed on the outer surface of the transfer belt 16. Instead, the image forming parameter may be set in the following procedure of (A)→(B)→(C)→(D)→(E) without being based only on the detected densities.

(A) A relational expression between the image forming parameters on the test conditions (conditions 1 to 3) and the detected densities of the line test images 22, 23 formed under the respective image forming parameters is obtained beforehand. Similarly, a relational expression between the image forming parameters on the test conditions (conditions 1 to 3) and the detected densities of the solid patch images 24 formed under the respective image forming parameters is obtained beforehand. The above relational expressions can be obtained by a known fitting process based on a linear, quadratic or higher-order function.

(B) The first setting section 103 calculates the image forming parameters, under which the line test image target density can be obtained, based on the relational expression between the image forming parameters on the test conditions 1 to 3 and the detected densities of the line test images 22, 23 formed under the respective image forming parameters.

(C) The solid patch image density discriminating section 105 calculates the density of the solid patch image 24 formed under the image forming parameter calculated in (B) based on the relational expression between the image forming parameters on the test conditions 1 to 3 and the detected densities of the solid patch images 24 formed under the respective image forming parameters, and then discriminates whether or not the density of this solid patch image 24 is equal to or above the solid patch image target density.

(D) If the calculated density of the solid patch image 24 is equal to or above the solid patch image target density, the first setting section 103 sets the image forming parameter calculated in (B) as the image forming parameter employed for the image forming process.

(E) On the other hand, if the calculated density of the solid patch image 24 is below the solid patch image target density, the second setting section 106 sets the image forming parameter instead of the first setting section 103. In this case, the second setting section 106 calculates the image forming parameter, under which the density of the solid patch image 24 equal to or above the solid patch image target density can be obtained, based on the relational expression between the image forming parameters on the test conditions 1 to 3 and the detected densities of the solid patch images 24 formed under the respective image forming parameters. This calculated parameter is set as the image forming parameter employed for the image forming process.

Here, the image forming parameter obtained in (E) has to lie in a specified range. Thus, it is desirable to calculate the image forming parameter, which lies in this range and under which the densities of the line test images 22, 23 are closest to the line test image target density, based on the relational expression between the image forming parameters on the test conditions 1 to 3 and the detected densities of the line test images 22, 23 formed under the respective image forming parameters. The thus calculated image forming parameter may be set as the image forming parameter employed for the image forming process.

Second Modification

In the above embodiment is exemplified the example in which the line test images 22, 23 are made up of a plurality of line images extending in the main scanning direction. Without being limited to this, line test images whose line images extend in various directions as shown in FIGS. 6A to 6E may be formed for the calibration process.

Figure 6A:
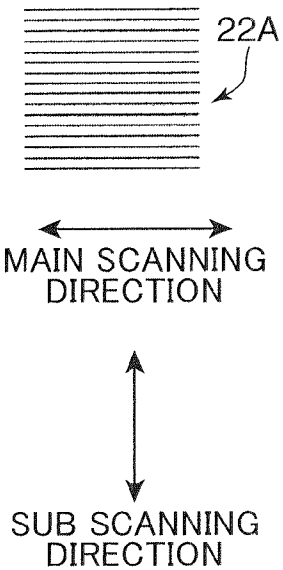
FIGS. 6A to 6E are diagrams showing other formation examples of line test images.

If directions indicated by arrows in FIG. 6A are defined to be the main scanning direction and the sub scanning direction, a line test image 22A (first line test image) shown in FIG. 6A is made up of line images (horizontal lines) extending in the main scanning direction (first direction). The main scanning direction is a direction orthogonal to the sub scanning direction and corresponds to the rotation axis direction of the above photoconductive drum 11 and that of the roller 17 for moving the transfer belt 16. The sub scanning direction corresponds to the circumferential direction of the photoconductive drum 11 and the moving direction of the transfer belt 16.

Figure 6B:
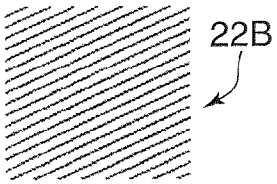
Figure 6C:
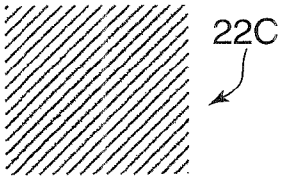
Figure 6D:
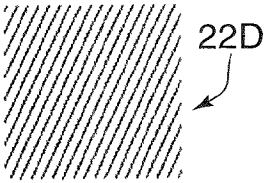
Figure 6E:
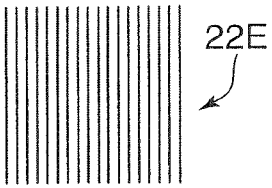

A line test image 22E (second line test image) shown in FIG. 6E is made up of line images (vertical lines) extending in the sub scanning direction (second direction). On the contrary, each of line test images 22B, 22C and 22D (third line test image) shown in FIGS. 6B, 6C and 6D is made up of line images extending in an oblique direction (third direction).

Specifically, the line test image 22C of FIG. 6C is made up of line images (oblique lines) extending in a direction at 45° between vertical lines and horizontal lines. In the line test image 22C, the density of the vertical lines and that of the horizontal lines are reflected at an equal ratio (50:50).

The line test image 22B of FIG. 6B is made up of line images (horizontally tilted oblique lines) extending in a direction between the oblique lines and the horizontal lines. The line images of the line test image 22B extend at an angle of about 67.5° in a clockwise direction with respect to the sub scanning direction. The line test image 22D of FIG. 6D is made up of line images (vertically tilted oblique lines) extending in a direction between the oblique lines and the vertical lines. The line images of the line test image 22D extend at an angle of about 22.5° in the clockwise direction with respect to the sub scanning direction.

In this way, by forming the line test images 22A to 22E in which the vertically tilted oblique lines, the oblique lines and the horizontally tilted oblique lines are arranged substantially at equal angular intervals while the angles thereof are changed stepwise between the vertical lines and the horizontal lines instead of the line test images 22, 23 whose line images simply extend in one direction, line thinning and line thickening in the respective directions can also be evaluated.

The five line test images 22A to 22E are treated as one set with a total of five line extending directions, and are outputted under a condition that both the charge voltage V0 of the photoconductive drum 11 and the development bias voltage Vdc of the development sleeve 15 have the same values. If being coupled with the above embodiment, the line test image forming section 102 forms the respective five line test images 22A to 22E under each of the image forming parameters (V0, Vdc) on the test conditions 1 to 3.

Then, the first setting section 103 suitably sets the image forming parameters according to the densities of these line test images 22A to 22E. The image forming parameters adjusted in this case are mainly the ratio of the circumferential speed S of the development sleeve 15 to the circumferential speed D of the photoconductive drum 11 (circumferential speed ratio: S/D), an emission period T of the laser light by the exposure unit 13 and the development bias voltage Vdc. Specifically, in the case of approximating the density of only the horizontal lines to an ideal density, S/D is changed. On the other hand, in the case of approximating the density of only the vertical lines to the ideal density, the emission period T of the exposure unit 13 is changed. Further, in the case of approximating the entire developer amount, i.e. both the density of the horizontal lines and that of the vertical lines to the ideal density, the development bias voltage Vdc is changed.

Figure 7:
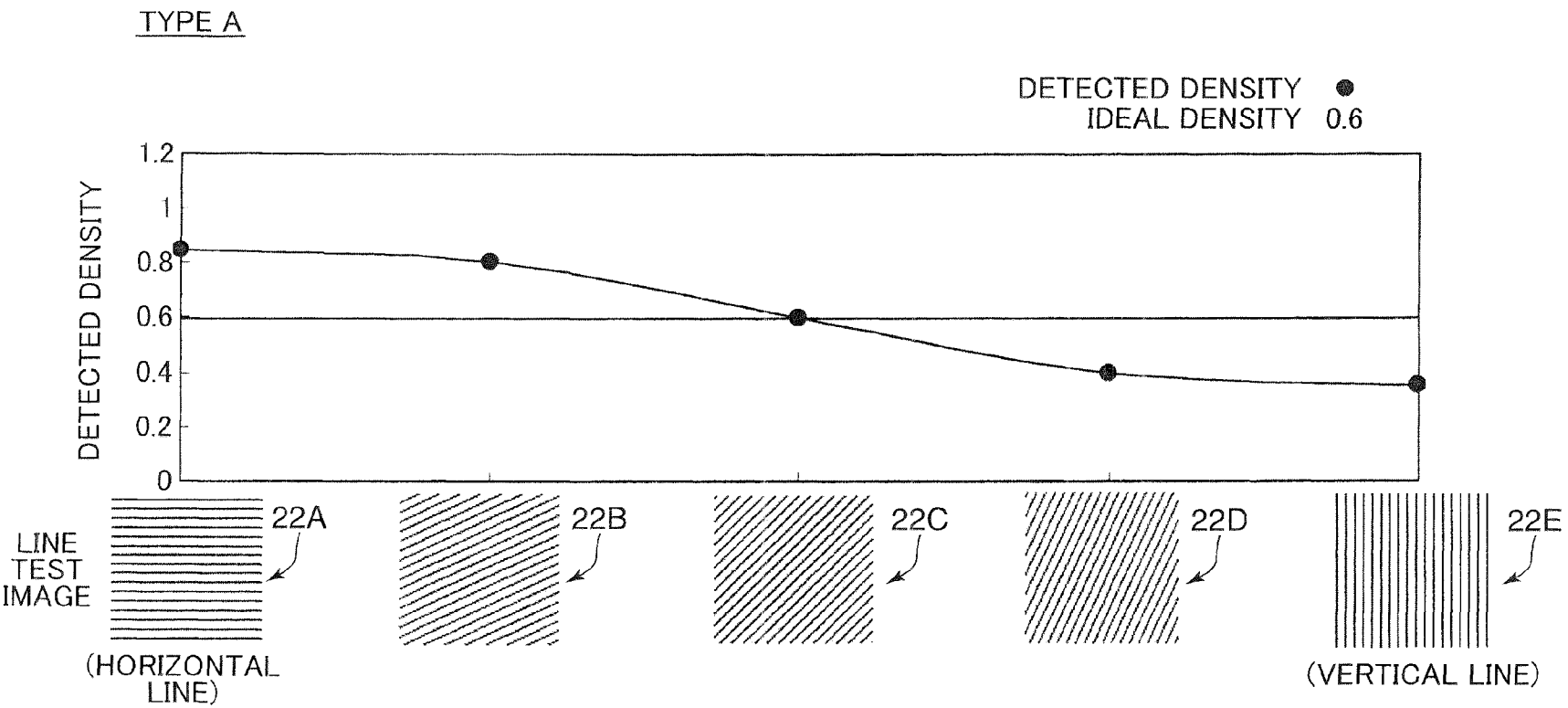
FIGS. 7 to 9 are graphs showing the calibration process using the line test images of FIGS. 6A to 6E.

The densities of the line test images 22A to 22E are respectively detected by the image density detecting sensor 20. A case is assumed where the density of the horizontal lines was detected to be about 0.85, that of the horizontally tilted oblique lines about 0.8, that of the oblique lines about 0.6, that of the vertically tilted oblique lines about 0.4 and that of the vertical lines about 0.35 as against the ideal density of about 0.6 as shown in FIG. 7 as a result of density detection. In this case, the densities of the horizontal lines and the horizontally tilted oblique lines are higher than the ideal density, and those of the vertically tilted oblique lines and the vertical lines are lower than the ideal density. Thus, a density status is "horizontal line thickening, vertical line thinning".

In this case, the first setting section 103 decreases S/D by adjusting the circumferential speed S of the development sleeve 15 or the circumferential speed D of the photoconductive drum 11. For example, a contact period between the photoconductive drum 11 and the development sleeve 15 is shortened by increasing the circumferential speed D of the photoconductive drum 11. As a result, the density of the horizontal lines is approximated to the ideal density. Further, the first setting section 103 extends the emission period T of the exposure unit 13 to extend an electrostatic latent image formation period. As a result, the density of the vertical lines is approximated to the ideal density.

Figure 8:
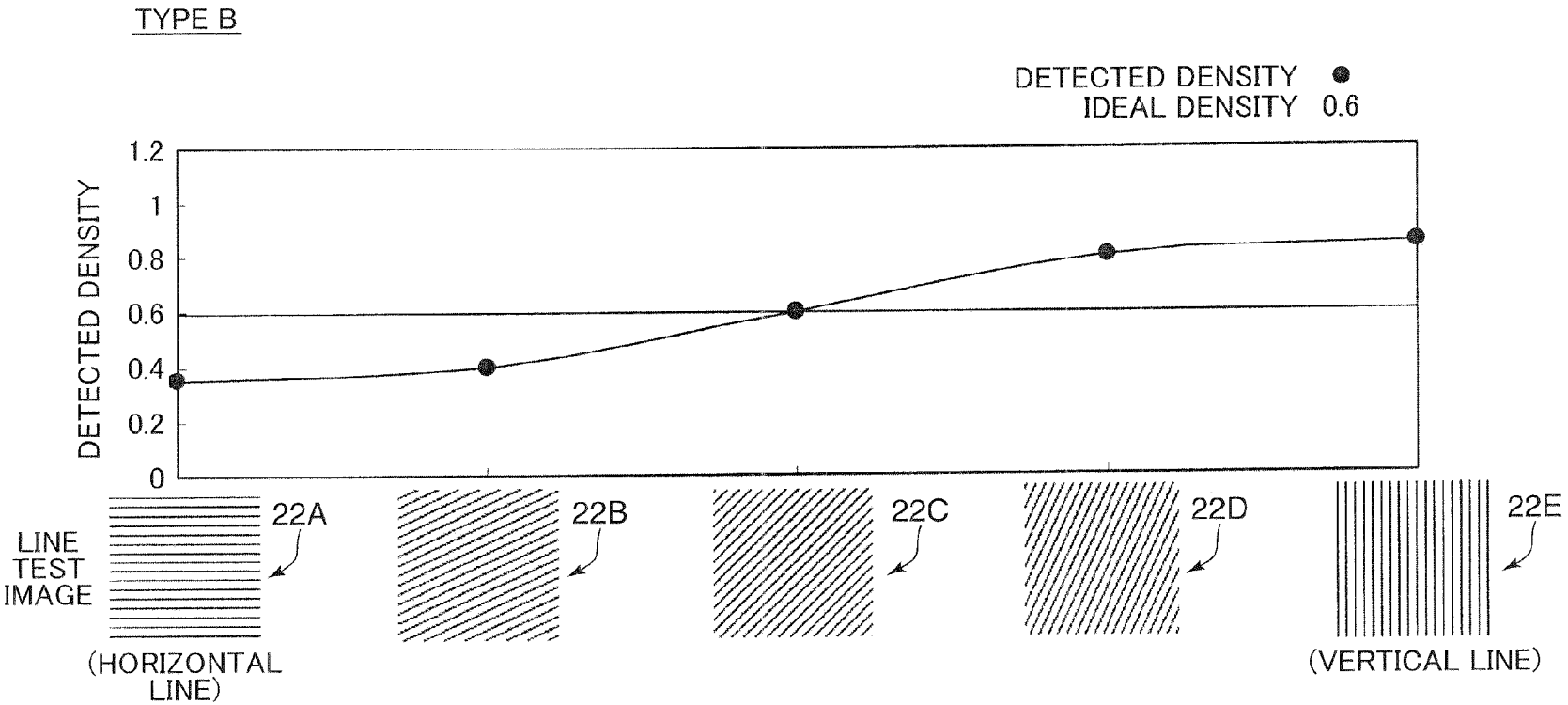

Further, a case is assumed where the density of the horizontal lines was detected to be about 0.35, that of the horizontally tilted oblique lines about 0.4, that of the oblique lines about 0.6, that of the vertically tilted oblique lines about 0.8 and that of the vertical lines about 0.85 as shown in FIG. 8. In this case, a density status is "horizontal line thinning, vertical line thickening".

In this case, the first setting section 103 increases S/D. For example, the circumferential speed D of the photoconductive drum 11 is decreased. As a result, the density of the horizontal lines is approximated to the ideal density. Simultaneously, the emission period T of the exposure unit 13 is shortened. As a result, the density of the vertical lines is approximated to the ideal density.

Figure 9:
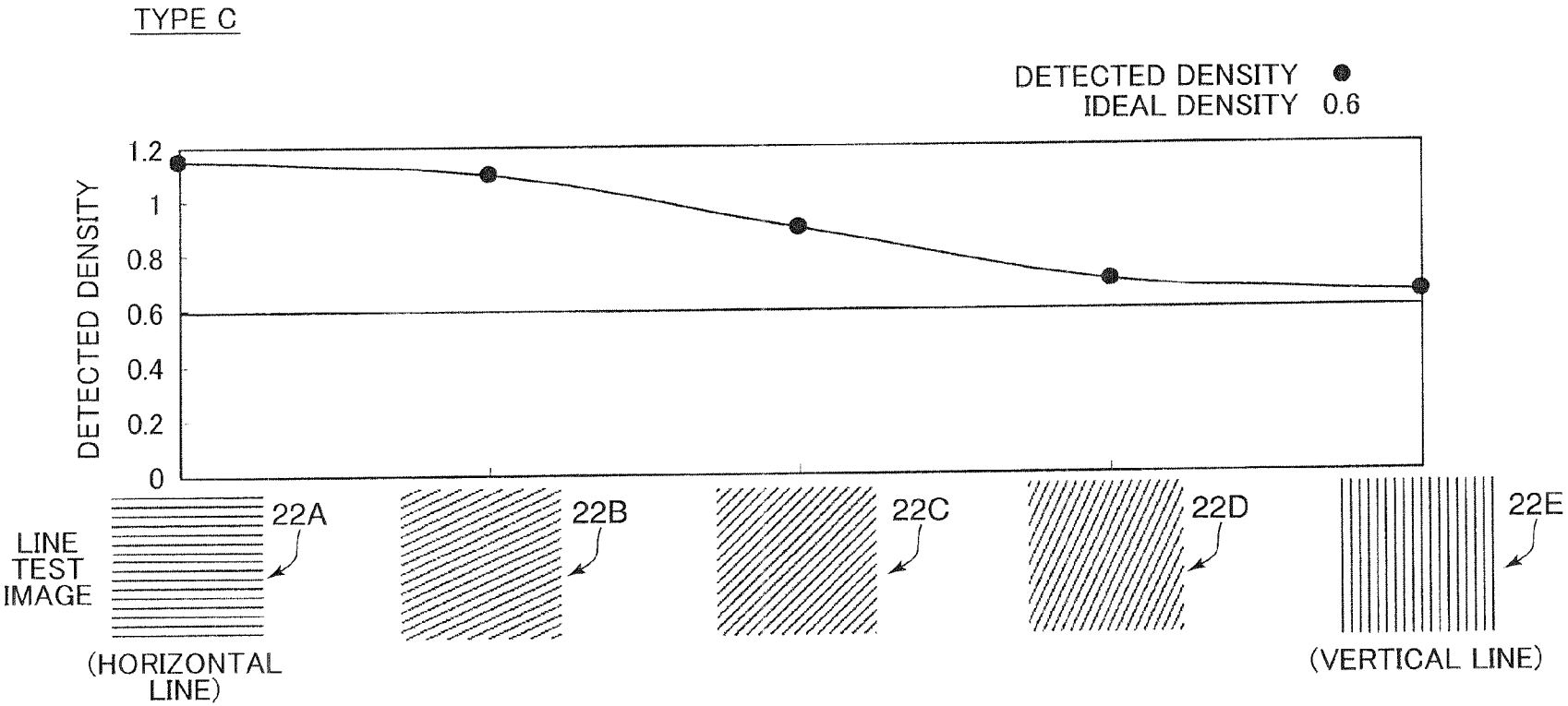

Furthermore, a case is assumed where the density of the horizontal lines was detected to be about 1.15, that of the horizontally tilted oblique lines about 1.1, that of the oblique lines about 0.9, that of the vertically tilted oblique lines about 0.7 and that of the vertical lines about 0.65 as shown in FIG. 9. In this case, since the densities of all the lines from the horizontal lines to the vertical lines are higher than the ideal density and the densities of the horizontal lines and the horizontally tilted oblique lines are particularly high, a density status is "line thickening as a whole, particularly horizontal line thickening".

In this case, the first setting section 103 decreases the development bias voltage Vdc to suppress the excitation of the toner. As a result, the densities of both the vertical lines and the horizontal lines are approximated to the ideal density. Simultaneously, S/D is decreased. As a result, the density of the horizontal lines can be further approximated to the ideal density.

According to the second modification, the thinning and thickening of lines (line drawings and characters) are more unlikely to occur and proper line performances (line drawing performance and character performance) can be obtained in addition to the advantages of the above embodiment. Further, toner shortage and unnecessary toner consumption are suppressed and the necessary and sufficient toner amount can be obtained. As a result, the operation conditions of the image forming apparatus X can be better calibrated.

The above specified embodiment mainly embraces inventions having the following constructions.

An image forming apparatus according to one aspect of the present invention comprises an image bearing member; a line test image forming section for forming a line test image made up of a plurality of line images arranged side by side on the image bearing member; an image density detecting section for detecting the density of the line test image formed on the image bearing member or the line test image transferred from the image bearing member to a transfer member; and a setting section for setting an image forming condition based on the density of the line test image.

According to this construction, the image forming condition can be properly set according to the density of the line test image, so that development is made with a necessary and sufficient developer amount.

In the above construction, it is preferable that a storage for storing a predetermined line test image target density is further provided; and that the setting section sets the image forming condition based on a comparison of the density of the line test image detected by the image density detecting section and the line test image target density. According to this construction, the density of the line test image can be properly evaluated.

In the above construction, it is preferable that a developer bearing member for supplying developer to the image bearing member is further provided; and that the image forming condition set by the setting section includes at least one of a charge voltage of the image bearing member and a development bias voltage of the developer bearing member.

An image forming parameter including at least one of the charge voltage of the image bearing member and the development bias voltage of the developer bearing member is an adjustable parameter having high sensitivity to the developer amount and having a low impact on line width. Here, the "adjustable parameter having high sensitivity to the developer amount" means an adjustable parameter having a high impact the developer amount. The developer amount required upon developing line images appears as the detected density of the line test image.

Accordingly, the image forming parameter can be so set as to form the line test image satisfying the target density by comparing the detected densities of the line test images outputted with the image forming parameter changed stepwise and the line test image target density. Thus, the image forming parameter (charge voltage and development bias voltage) can be so adjusted that the line images are developed with the necessary and sufficient developer amount. Further, even if such an adjustment is made, the line width is unlikely to be thickened or conversely thinned. As a result, good image quality can be realized upon developing images of characters and line drawings.

In the above construction, it is preferable that a solid patch image forming section for forming a solid patch image on the image bearing member is further provided; and that the setting section sets the image forming condition based on the density of the line test image and the density of the solid patch image.

The image forming parameter adjusted for the development of line images (characters and line drawings) normally provides a sufficient image density also in the development of a solid patch image in many cases. However, the image density may be insufficient in the development of a solid patch image in rare cases. Particularly, the more the density of the line test image is approximated to such an ideal density as to reduce the developer amount, the more likely such a situation is to occur. Therefore, more proper calibration can be performed by referring to the density of the solid patch image.

In this case, the setting section preferably can set a first image forming condition derived from the density of the line test image and a second image forming condition derived from the density of the solid patch image and sets the first image forming condition if the density of the solid patch image is equal to or above a specified target density. The setting section preferably sets the second image forming condition if the density of the solid patch image is below the specified target density.

According to this construction, it is possible to set the image forming parameter capable of developing the line images with the necessary and sufficient developer amount within such a range that the minimum density of the solid patch image can be ensured.

In the above construction, the line test image forming section preferably forms a plurality of line test images under a plurality of first test conditions in which a specified image forming parameter differs. According to this construction, an optimal density can be easily searched.

In this case, it is preferable that a storage for storing a predetermined line test image target density is further provided; and that the setting section sets the image forming parameter of the line test image, whose density is closest to the line test image target density, out of the plurality of line test images as the image forming condition.

In the above construction, it is preferable that the line test image forming section forms a plurality of line test images under a plurality of first test conditions in which a specified image forming parameter differs; that the solid patch image forming section forms a plurality of solid patch images under a plurality of second test conditions in which a specified image forming parameter differs; and that the first and second test conditions are substantially same. According to this construction, an adjustment time can be shortened since the test conditions for forming the line test image and the solid patch image are same.

In the above construction, the image density detecting section detects the density based on a reflected light quantity.

In the above construction, it is preferable that the line test image forming section forms a first line test image whose lines extend in a first direction, and a second line test image whose lines extend in a second direction orthogonal to the first direction.

In this case, it is preferable that the line test image forming section further forms a third line test image whose lines extend in a third direction different from the first and second directions. It is also preferable that the first direction is a main scanning direction and the second direction is a sub scanning direction.

According to this construction, the thinning and thickening of lines (line drawings and characters) are more unlikely to occur and proper line performances (line drawing performance and character performance) can be obtained. Further, toner shortage and unnecessary toner consumption are suppressed and the necessary and sufficient toner amount can be obtained. As a result, the operation conditions of the image forming apparatus can be better calibrated.

In the above construction, it is preferable that a developer bearing member for supplying developer to the image bearing member and an exposure unit for forming an electrostatic latent image by exposing the image bearing member with light are further provided; and that the image forming condition set by the setting section includes at least one of a ratio of the surface speed of the image bearing member to the surface speed of the developer bearing member and an exposure period to the image bearing member by the exposure unit.

This application is based on Japanese Patent application serial Nos. 2007-305744 and 2008-079521 in Japan Patent Office, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image bearing member;

a line test image forming section for forming a line test image made up of a plurality of line images arranged side by side on the image bearing member;

an image density detecting section for detecting the density of the line test image formed on the image bearing member or the line test image transferred from the image bearing member to a transfer member;

a setting section for setting an image forming condition based on the density of the line test image; and a solid patch image forming section for forming a solid patch image on the image bearing member, wherein the setting section can set a first image forming condition derived from the density of the line test image and a second image forming condition derived from the density of the solid patch image and sets the first image forming condition if the density of the solid patch image is equal to or above a specified target density.

2. An image forming apparatus according to claim 1, further comprising a storage for storing a predetermined line test image target density, wherein the setting section sets the image forming condition based on a comparison of the density of the line test image detected by the image density detecting section and the line test image target density.

3. An image forming apparatus according to claim 1, further comprising a developer bearing member for supplying developer to the image bearing member, wherein the image forming condition set by the setting section includes at least one of a charge voltage of the image bearing member and a development bias voltage of the developer bearing member.

4. An image forming apparatus according to claim 1, wherein the setting section sets the second image forming condition if the density of the solid patch image is below the specified target density.

5. An image forming apparatus according to claim 1, wherein the line test image forming section forms a plurality of line test images under a plurality of first test conditions in which a specified image forming parameter differs.

6. An image forming apparatus according to claim 5, further comprising a storage for storing a predetermined line test image target density, wherein the setting section sets the image forming parameter of the line test image, whose density is closest to the line test image target density, out of the plurality of line test images as the image forming condition.

7. An image forming apparatus according to claim 1, wherein:

the line test image forming section forms a plurality of line test images under a plurality of first test conditions in which a specified image forming parameter differs;

the solid patch image forming section forms a plurality of solid patch images under a plurality of second test conditions in which a specified image forming parameter differs; and the first and second test conditions are substantially same.

8. An image forming apparatus according to claim 1, wherein the image density detecting section detects the density based on a reflected light quantity.

9. An image forming apparatus comprising:

an image bearing member;

a line test image forming section for forming a line test image made up of a plurality of line images arranged side by side on the image bearing member;

an image density detecting section for detecting the density of the line test image formed on the image bearing member or the line test image transferred from the image bearing member to a transfer member;

a setting section for setting an image forming condition based on the density of the line test image, wherein the line test image forming section forms a first line test image whose lines extend in a first direction, and a second line test image whose lines extend in a second direction orthogonal to the first direction.

10. An image forming apparatus according to claim 9, wherein the line test image forming section further forms a third line test image whose lines extend in a third direction different from the first and second directions.

11. An image forming apparatus according to claim 9, wherein the first direction is a main scanning direction and the second direction is a sub scanning direction.

12. An image forming apparatus according to claim 9, further comprising:

a developer bearing member for supplying developer to the image bearing member; and an exposure unit for forming an electrostatic latent image by exposing the image bearing member with light, wherein the image forming condition set by the setting section includes at least one of a ratio of the surface speed of the image bearing member to the surface speed of the developer bearing member and an exposure period to the image bearing member by the exposure unit.

13. An image forming apparatus, comprising:

an image bearing member;

a line test image forming section for forming a line test image made up of a plurality of line images arranged side by side on the image bearing member;

an image density detecting section for detecting the density of the line test image formed on the image bearing member or the line test image transferred from the image bearing member to a transfer member;

a setting section for setting an image forming condition based on the density of the line test image; and a storage for storing a predetermined line test image target density, wherein the line test image forming section forms a plurality of line test images under a plurality of first test conditions in which a specified image forming parameter differs, and the setting section sets the image forming parameter of the line test image, whose density is closest to the line test image target density, out of the plurality of line test images as the image forming condition.

14. An image forming apparatus according to claim 13, further comprising a developer bearing member for supplying developer to the image bearing member, wherein the image forming condition set by the setting section includes at least one of a charge voltage of the image bearing member and a development bias voltage of the developer bearing member.

15. An image forming apparatus, comprising:

an image bearing member;

a line test image forming section for forming a line test image made up of a plurality of line images arranged side by side on the image bearing member;

an image density detecting section for detecting the density of the line test image formed on the image bearing member or the line test image transferred from the image bearing member to a transfer member;

a setting section for setting an image forming condition based on the density of the line test image; and a solid patch image forming section for forming a solid patch image on the image bearing member, wherein the setting section sets the image forming condition based on the density of the line test image and the density of the solid patch image;

the line test image forming section forms a plurality of line test images under a plurality of first test conditions in which a specified image forming parameter differs;

the solid patch image forming section forms a plurality of solid patch images under a plurality of second test conditions in which a specified image forming parameter differs; and the first and second test conditions are substantially same.

16. An image forming apparatus according to claim 15, further comprising a developer bearing member for supplying developer to the image bearing member, wherein the image forming condition set by the setting section includes at least one of a charge voltage of the image bearing member and a development bias voltage of the developer bearing member.

* * * * *